US006076638A

United States Patent [19]

Gertz

[11] Patent Number: 6,076,638

[45] **Date of Patent: *Jun. 20, 2000**

[54] SPECIAL EFFECTS ELEVATOR

[75] Inventor: Laurence D. Gertz, LaCañada-Flintridge, Calif.

[73] Assignee: Disney Enterprises, Inc., Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/298,082

[22] Filed: Apr. 22, 1999

[51] Int. Cl.[7] ..... B66B 31/00

[52] U.S. Cl. ..... 187/414; 472/131; 472/58; 472/61

[58] Field of Search ..... 187/414, 401; 472/2, 131, 57, 58, 61, 63, 64, 65, 72

[56] References Cited

U.S. PATENT DOCUMENTS

| | | | |
|---|---|---|---|
| 2,888,857 | 6/1959 | Stevenson et al. | 472/58 X |
| 4,026,066 | 5/1977 | Reiner et al. | 472/71 X |
| 4,953,848 | 9/1990 | Braunstein et al. | 472/63 X |
| 5,346,433 | 9/1994 | Weinreich | 472/63 |
| 5,865,519 | 2/1999 | Maass | 472/58 X |

FOREIGN PATENT DOCUMENTS

| | | | |
|---|---|---|---|
| 7-206277 | 8/1995 | Japan | B66B 1/06 |

*Primary Examiner*—Robert P. Olszewski
*Assistant Examiner*—Thuy V. Tran
*Attorney, Agent, or Firm*—Medlen & Carroll, LLP

[57] ABSTRACT

An elevator for moving passengers from a first, outside level to a second, inside level at a theme park, and for providing themed special effects during the journey is provided. The elevator includes an elevator car divided into a passenger compartment and a special effects equipment compartment. The passenger compartment appears to the unsuspecting passenger to be a conventional elevator. However, at least one partition in the passenger compartment is opaque when the passenger compartment is illuminated and becomes transparent to reveal illuminated special effects when the lighting in the passenger compartment is extinguished. Special effects equipment can include a pair of video projectors for creating a virtual image which appears to be located outside of the elevator car, along with audio speakers for generating appropriate sound to accompany a video sequence for creating an active visual and audio presentation which can be appropriately themed. In addition, the special effects equipment may include special lights, equipment for inducing vibrations, sparks and smoke, fans for creating air flow in the passenger compartment, scent generators, water spray generators, and the like. The special effects equipment contained in the special effects equipment compartment is controlled by a special effects controller, which may be located off the elevator car and linked to the special effects equipment via the elevator control cable.

18 Claims, 3 Drawing Sheets

SPECIAL EFFECTS ELEVATOR

FIELD OF THE INVENTION

This invention relates to elevators and, more particularly, to elevators which include audio/visual special effects.

BACKGROUND OF THE INVENTION

Conventional elevators are typically used to transport passengers from a first level upwards to a second level, or from a second level downwards to a first level. Such conventional elevators consist of an elevator shaft connecting the first and second levels, an elevator car mounted in the elevator shaft for movement between the first and second levels, a means for moving the elevator car in the shaft, such as a motor driven winch and cable, call buttons on the first and second levels to create a signal when a passenger on that level wishes to use the elevator, and an elevator controller for controlling the means for moving the elevator. In conventional elevator cars, substantially the entire car is intended to carry passengers. Such cars may include a video camera for security purposes, speakers for broadcasting "elevator music," speech or sound synthesizers for indicating the floors on which the elevator stops, and graphic or text displays for displaying information pertinent to the passengers, such as the floor which will be the next stop, time of day, weather, conference schedules, etc.

Elevators have also found use in theme parks, not as elevators per se, but as part of an attraction. For example, in the Haunted Mansion of Disneyland, California (c. 1967), guests previously waiting in the dimly lit foyer are invited by a spooky voice to move into the adjoining room. There, after the doors are closed behind them, the guests find themselves trapped in a room that stretches (or are they shrinking?). Paintings elongate to reveal that what at first appeared to be ordinary portraits actually depict the demise of their subject, in anticipation of the paranormal displays to come. The Haunted Mansion stretching room is a combination of an elevator platform which lowers, and an apparently solid ceiling which moves in opposition to the floor (and later vanishes in a lightning flash to reveal a hanging corpse). Midway up the walls in the initial position is a mantle, which keeps pace with the floor for a portion of its travel, and then slows to exaggerate the stretching/shrinking effect. The walls are in immediate reach of guests, who are warned to keep away from them, and it is unclear whether defeat of the illusion or a friction burn is the more significant hazard. The room is essentially a series of concentric, telescoping surfaces. The actual descent of the elevator platform is usefully employed to lower guests to a passage beneath the railroad which circumnavigates the park grounds.

In Living Seas at EPCOT, Walt Disney World, Florida (c. 1984) guests view a film depicting a hypothetical undersea research facility. The final sequence shows a schematic of the "hydrolator" vertical lift shafts providing access to the deep water "Seabase Alpha" from an ocean surface platform. Theater doors open to recapitulate in reality the final image of the film, the hydrolator lobby. Guests in small parties wait at one of the several operating hydrolators, which arrive, open their doors to accept guests, close again, and depart. Inside, guests can observe their descent through portals in the sides of the hydrolator cabin. An indicator marks off their descent. Once stopped many hundreds of feet below the surface, another door opens and the guests are received into the Seabase, where fish and other oceanic forms are visible outside large, panoramic windows. Seabase Alpha's hydrolators are phoney. There is no elevator action, and guests are not so much as an inch displaced as they enter one door and exit through the next. The floor of the cabin is on a flexible mounting, and shakes during the simulated descent. Special effects conveyor belts scrolling vertically past the portals, the depth gauge, and sound effects conspire to provide the remaining cues of a deep descent.

The Twilight Zone Tower of Terror at Walt Disney/MGM Studio Tour in Walt Disney World, Florida (c. 1990), provides an entire show while passengers remain seated in their elevator cab. In fact their cab is an autonomous vehicle which, at the beginning of the show, is positioned inside a first elevator lift. Guests are transported to a first show position, where the real elevator's doors open and the guests witness a special effects sequence located at that floor of the building. The doors close, and the guests are transported to a second floor where their cabin trundles through a show set and, under cover of darkness, enters a second elevator lift. This second lift is of considerably higher performance and is able to hoist the cab quite rapidly and then provide one or more zero-G drops.

In Caesar's Palace, Las Vegas, Nev., the Caesar's Magical Empire dinner show first admits guests into an Egyptian themed treasure room. As with the Haunted Mansion elevator, this is a disguised elevator platform. As the floor begins its descent, more and more of the rough-hewn rock walls of the chamber are revealed until the bottom of the travel is reached. There, a door appears and opens to admit guests to a the secret dining catacombs.

None of these prior art attractions attempt to disguise a ride or other special effects attraction as a conventional elevator. Accordingly, a need exists for an elevator which functions as and appears to be a conventional elevator, but which can selectively provide an extraordinary special effects experience to an unsuspecting passenger.

SUMMARY OF THE INVENTION

The present invention provides a special effects elevator which has the interior and exterior appearance of a convention elevator, but which is capable of selectively generating predetermined special effects to an elevator passenger using an elevator car which is divided into a passenger compartment and an equipment compartment for mounting special effects equipment, and a partition between said passenger compartment and said equipment compartment for hiding the equipment compartment, at least a portion of the partition facing the passenger compartment having the appearance of a mirror while the passenger compartment is illuminated and becoming substantially transparent when the passenger compartment is darkened and the equipment compartment is illuminated, for example by a video image projected on a screen behind the partition, revealing special effects created by said special effects equipment.

In one embodiment, the special effects equipment includes a video projector and a projector screen mounted substantially parallel with the partition and at the passenger's eye level for displaying to the passenger a first predetermined video sequence projected onto the projector screen by the video projector.

In another embodiment, the special effects equipment additionally includes a 50% mirror having a front reflective surface and a rear surface mounted between the partition and the projector screen with the front reflective surface facing the partition at approximately 315 degrees relative to the projector screen, a mirror mounted above and substantially parallel to the 50% mirror, a second projector screen mounted substantially perpendicular to the partition on the floor of the elevator car and facing the front reflective surface of the 50% mirror, and a second video projector for reflecting a second video sequence screen off the mirror, through the rear surface of the 50% mirror and onto the second projection screen, whereby said first video sequence and said second video sequence are combined to produce a single, virtual image which appears to the passenger to be positioned outside the elevator car.

In yet another embodiment, the special effects equipment may includes a robotic or animatronic character for "talking" to the passenger.

Other features and advantages of the invention will become apparent from the following detailed description, taken in conjunction with the accompany drawings, which illustrate, by way of example, the principles of the invention.

DETAILED DESCRIPTION OF THE PREFERRED EMBODIMENTS

The present invention is particularly suited to providing a transition into an urban, indoor theme park which provides attractions on different floors in order to minimize the required ground space for the facility. A goal is to induce each guest stepping out of the busy urban environment to forget the too-real world and enter, physically and mentally, into another realm, which the overall entertainment facility provides. The mindset of the guest upon reaching the entertainment destination will significantly influence the perception of that venue, hence the importance of capturing and jarring their expectations as completely, quickly and effectively as possible.

Figure 1:
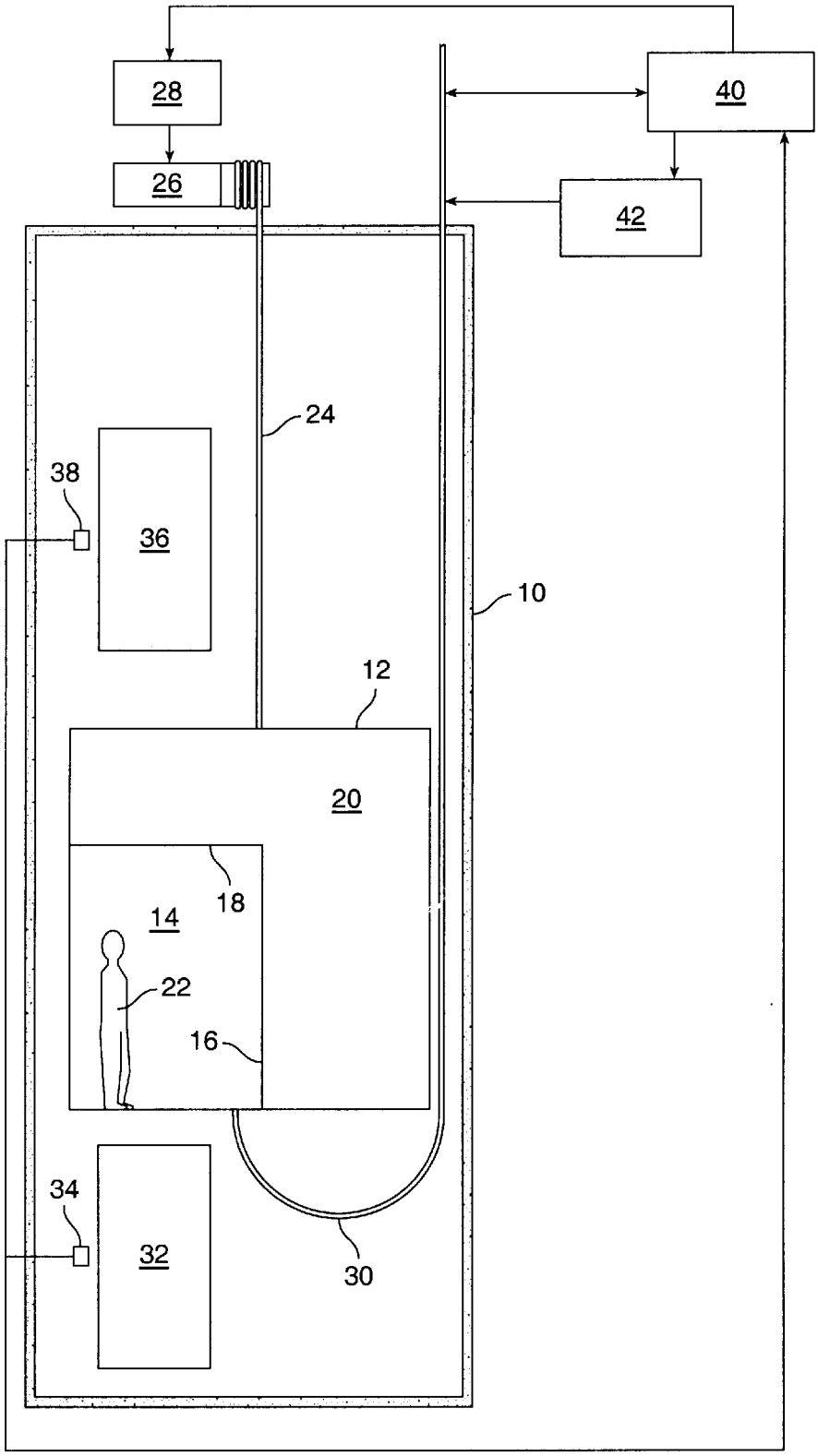
FIG. 1 is a cut-away, side view of a special effects elevator of the present invention.

FIG. 1 illustrates the general features of the present invention. A special effects elevator of the present invention includes a substantially vertical elevator shaft 10 connecting a first level and a second level which are vertically separated. For example, the first level could correspond to a ground or lobby level, and the second level could be the top floor in the facility. A first level elevator door 32 with a call button 34 is provided on the first level, and a second level elevator door 36 with a call button 38 is provided on the second level. An elevator car 12 is mounted for movement in said elevator shaft 10. Elevator car 12 includes a passenger compartment 14 and a special effects equipment compartment 20. Passenger compartment 14 is constructed to appear to be a conventional elevator car, and includes interior lighting, a door or opening is provided in the elevator car 12 to allow passenger ingress and egress through the first level elevator door 32 or second level elevator door 36. A control panel may be provided to allow the passenger to select the destination floor; however, such a control panel is not necessary if the elevator only travels between two floors and cannot stop in between. The passenger cannot see, and does not know, that wall 16 and ceiling 18 are really partitions between the passenger compartment 14 and the special effects equipment compartment 20. Special effects equipment, discussed in detail below, are mounted in equipment compartment 20 for generating special effects to the passenger during a trip between the first and second levels.

Elevator car 12 can be raised and lowered using any conventional means, such as, for example, a hoist cable 24 mounted on a winch 26 which is rotated to raise or lower the elevator car by motor control 28. The location of the elevator car 12 can be conventionally determined by signals generated by sensors (not shown) which communicate with the elevator control system 40. Communications between the elevator control system and the elevator car 12 are conventionally transmitted through elevator control cable 30.

Figure 2:
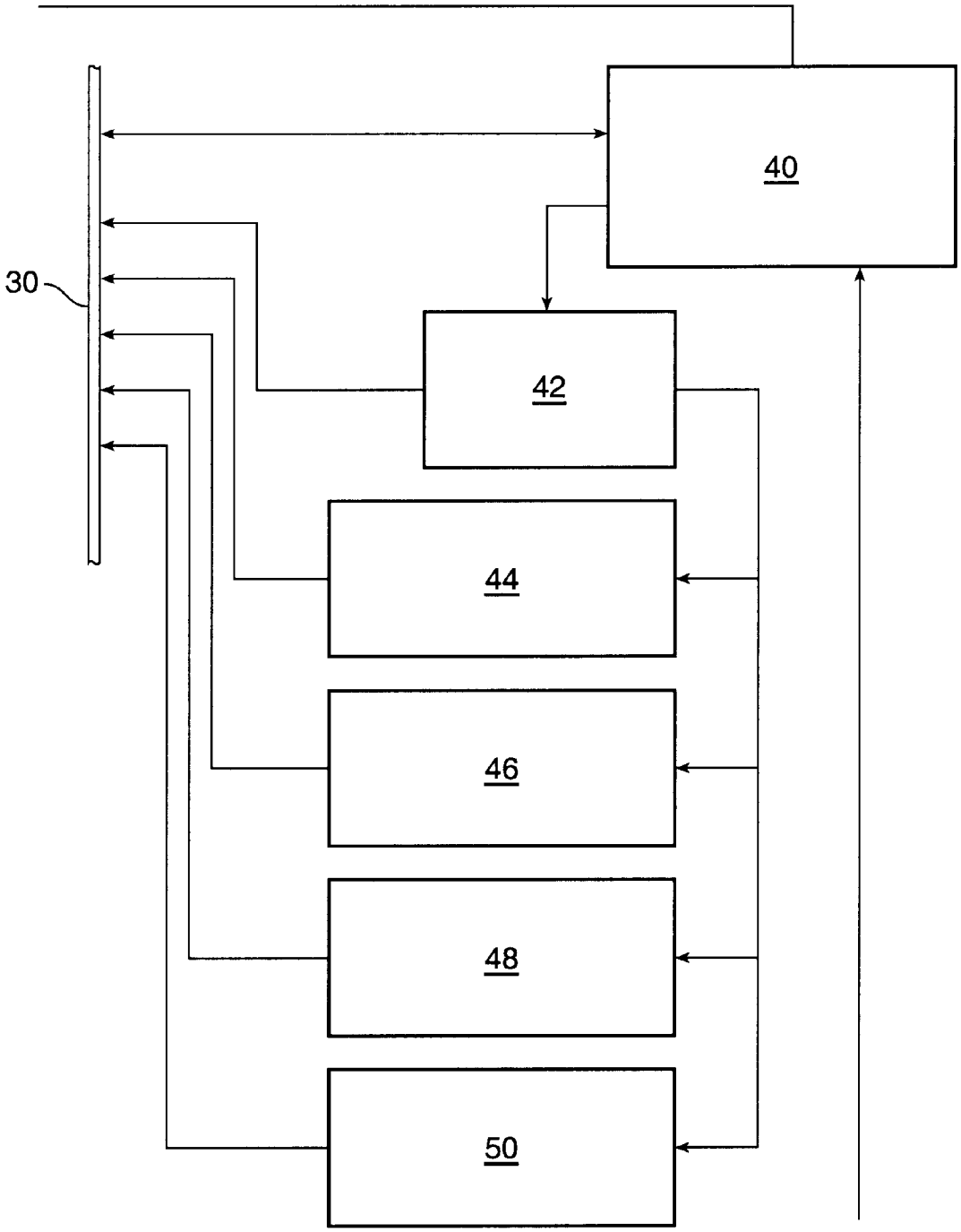
FIG. 2 is a block diagram illustrating an arrangement for controlling the generation of special effects in the elevator of FIG. 1; and, FIG. 3 is a cut-away, side view of an elevator car of the elevator of FIG. 1.

A special effects controller 42 and signal sources are used to control the generation of special effects. This equipment is preferably located at a fixed location and linked to the special effects equipment mounted in equipment compartment 20 through elevator control cable 30. However, it may also be possible (although space is tight) to locate the special effects controller 42 in the special effects equipment compartment and to link the controller 42 and special effects equipment using conventional cables. In the preferred embodiment, as shown in more detail in FIG. 2, the audio and video program signals, as well as the effects and projector control signals, originate remotely. Thus, special effects controller 42 is linked to, controls and coordinates video source 44, audio source 46, projector controller 48, and lighting controller 50, whose signals are preferably transmitted to the on-board video projectors, speakers, and lights through elevator control cable 30.

Figure 3:
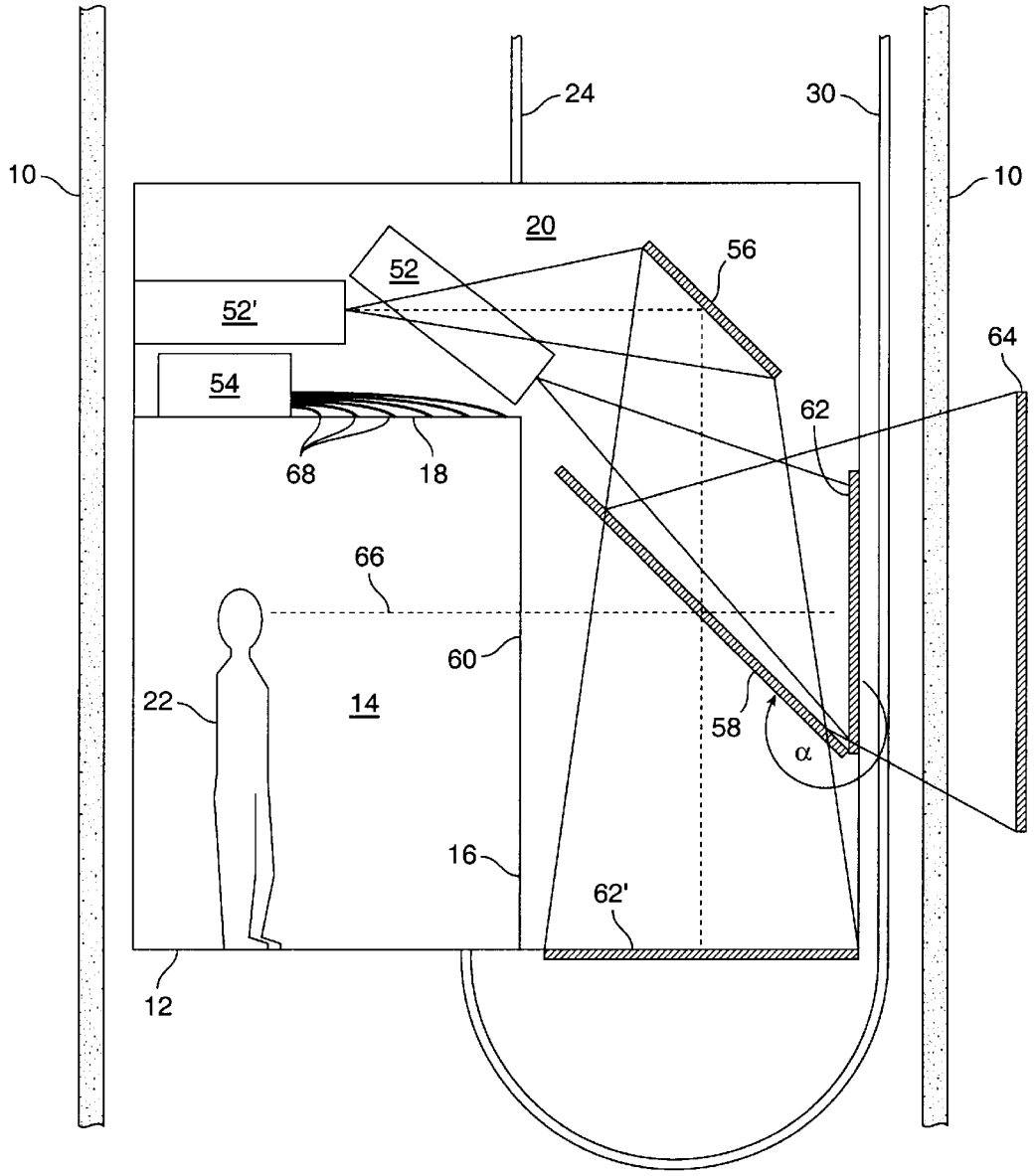

As shown in FIG. 3 special effects equipment compartment 20 of elevator car 12 is preferably provided with special effects equipment for producing a video sequence viewable in an unexpected way by the passenger 22 in the passenger compartment 14. To reduce the footprint so that the equipment can be carried on board the elevator, projection systems preferably are folded or stacked to use the space over or under the passenger compartment efficiently. The special effects equipment preferably includes a first video projector 52 which receives a video signal from the video source 44 (shown in FIG. 2), and is controlled by the projector controller 48, most preferably through elevator control cable 30. First video projector 52 projects its image onto a first projector screen 62 which is positioned to be substantially parallel to partition (or wall) 15 and located along the line of sight 66 of passenger 22. To enable the passenger 22 to view the image on screen 62 at a desired moment, a part or all of wall 16 is formed from a 50% mirror 60 having its reflective side facing the interior of passenger compartment 14, and its non-reflective side facing the interior of special effects equipment compartment 20. A 50% mirror is a mirror which reflects approximately 50% and transmits approximately 50% of the light which strikes its reflective (or mirrored) surface. Accordingly, so long as the interior of the passenger compartment 14 is illuminated, the 50% mirror will appear, to the passenger 22, to be an ordinary mirror. However, when the lights inside the passenger compartment 14 are extinguished, and the video projector 52 begins to project a predetermined video sequence, the 50% mirror will become substantially transparent, and passenger 22 will view the sudden appearance of the video sequence.

A more convincing video display can be created by adding equipment sufficient to give the video sequence depth, making it appear to be a scene taking place at a distance outside the elevator car. This can be created by using a second video projector 52' which receives a video signal from video source 44 and is controlled by projector controller 48, preferably through elevator control cable 30.

The image projected by video projector 52' is preferably bent 90 degrees by using a mirror 56 and is projected onto a projector screen 62' which is preferably mounted on the floor of elevator car 12. This arrangement provides a long focal length, allowing projector 52' to project distant elements in the video sequence, while projector 52 projects near elements in the video sequence. The images projected by projectors 52 and 52' are combined using a 50% mirror 58 which is positioned along the line of sight 66 of passenger 22 with its reflective surface facing both the passenger compartment 14 and the second screen 62' at an angle $\alpha$ of about 315 degrees relative to screen 62. With this arrangement, the images projected on screen 62' are reflected onto the reflective surface of 50% mirror 58 and are combined with the images projected onto screen 62 (which can be seen through the front surface of 50% mirror 58 by passenger 22) to produce a virtual image 64 which appears to be located well outside elevator car 12.

Audio is an important part of the presentation. Localization techniques permit the placement of sounds in various locations inside (and potentially outside) the cabin. Speakers (not shown) can be embedded in the ceiling 18, floor or walls of passenger compartment 14, or elsewhere on the elevator cab, to provide the desired effects is projecting the audio which accompanies the video to present a realistic looking and sounding experience. The speakers receive an audio signal preferably through elevator control cable 30 from audio source 46 (shown in FIG. 2).

Lighting is controlled as a part of the show. This permits guests to be plunged into darkness, or the lights may merely be dimmed to allow other effects to be better viewed (much as the lights in a theatre dim prior to the beginning of the show). Additional effects can be provided by special lighting 68 in the passenger compartment 14, such as, for example, fiber optics or strobes. These can be used to simulate a malfunction of the elevator. In addition, if desired, speakers or other devices could be used to simulate unusual vibrations in the elevator, spark generators and smoke simulators could be used to create or reinforce the impression of a malfunction. Fans could be used to move air past the passenger in a particular direction to create the impression that the elevator is moving quickly in the direction that the air flow is coming from.

A special effects elevator of the present invention is preferably used as the entrance device to a theme park or attraction, and serves as a transition from the ordinary world to the extraordinary world within the park or attraction. For the purposes of this disclosure, "theme park" can mean an entire park with a plurality of attractions, or a single attraction. While a single elevator may be used, a bank of like elevators are preferred to enable the transfer of many passengers at one time.

The process begins with the seemingly ordinary undertaking of entering an elevator. The passenger arrives, and summons an elevator using a conventional call button typically located adjacent to the elevator door on a first level. A few moments later, the elevator doors open. There may be a conventional audible or visual signal (e.g., a bell rings or a light above the elevator door illuminates) signalling the arrival of the elevator. The passenger sees what appears to be a conventional elevator car. "Elevator music" may be playing through the speakers. The unsuspecting passenger steps inside, and if there is a control panel, depresses the button for the second level. Even before the elevator doors fully close, unexpected behaviors wrench the passengers to an awareness that something is very unusual. For example, the lights in the elevator could flicker and die, or be suddenly extinguished. At the same time, the elevator could suddenly stop. Just as the passenger believes the elevator is malfunctioning, the video and audio portions begin. Suddenly, the passenger can see through what appeared to be an ordinary mirror, to the outside of the elevator. What an instant before was an everday, marginally claustrophobic elevator cab, is suddenly revealed to be very different: a part of something much larger. An array of special effects dazzle the occupants and commands their attention to a story being told. The real world just left behind is completely and immediately forgotten.

The video and audio sequence may include a character who quickly tells a tale to the passenger. This may be followed by actions on the video sequence, and special effects in the elevator car, which reinforce the tale. By the time the special effects sequence is complete, the elevator car has arrived at the second level. If desired, the special effects sequence can be ended with a great flash of light from a strobe inside the passenger compartment, temporarily blinding the passenger while the elevators doors open. The passenger, whose normal vision recovers quickly, steps out of the elevator and into the world of the theme park.

In order to achieve maximum impact, the expectation of the guests need to be misdirected. Access doors for the elevator telegraph a common urban experience (an elevator). When the doors open, that message is reinforced: the passenger compartment appears as an ordinary passenger elevator car. The object of the ordinary appearance is two-fold: the management and presentation of that transition is important, as it is necessary to capture and redirect the guest's attention toward their upcoming experience, and it is also far more persuasive when the experience defies expectations.

While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

We claim:

1. A special effects elevator capable of selectively generating predetermined special effects to an elevator passenger, comprising:

an elevator shaft connecting a first level and a second level;

a first level elevator door on said first level opening to said elevator shaft;

a second level elevator door on said second level opening to said elevator shaft;

an elevator car mounted in said elevator shaft for movement between said first level and said second level, said elevator car divided into a passenger compartment and an equipment compartment, said passenger compartment having the appearance of a conventional elevator passenger compartment, said passenger compartment including a passenger compartment door cooperating with said first level and said second level elevator doors;

special effects equipment installed in said equipment compartment;

a partition between said passenger compartment and said equipment compartment, at least a portion of said partition being opaque while the passenger compartment is illuminated, said partition becoming substantially transparent when said passenger compartment is darkened and said equipment compartment is illuminated;

an elevator controller for controlling the elevator doors and the movement of the elevator between said first level and said second level; and, a special effects controller for controlling the special effects equipment.

2. The special effects elevator of claim 1 wherein said special effects equipment includes a video projector and a projector screen mounted substantially parallel with the partition and along the passenger's line of sight for displaying to the passenger a first predetermined video sequence projected onto the projector screen by the video projector.

3. The special effects elevator of claim 2 wherein said special effects equipment includes audio equipment for creating predetermined sounds.

4. The special effects elevator of claim 3 wherein said special effects equipment additionally includes a robotic figure.

5. The special effects elevator of claim 1 wherein said special effects equipment additionally includes special effects lights for selectively illuminating said passenger compartment.

6. The special effects elevator of claim 5 wherein said lights are selected from the group consisting of strobe lights and fiber optics.

7. The special effects elevator of claim 1 wherein said partition is formed from a first 50% mirror having a reflective surface facing the passenger compartment.

8. The special effects elevator of claim 2 wherein said special effects equipment additionally includes a second 50% mirror having a front reflective surface and a rear surface, said second 50% mirror mounted between said partition and said projector screen at approximately 315 degrees relative to said projector screen with said front reflective surface facing said partition and said rear surface facing said projector screen, a mirror mounted above and substantially parallel to said second 50% mirror, a second projector screen mounted substantially perpendicular to said partition and facing said front reflective surface, and a second video projector for reflecting a second video sequence screen off said mirror, through said rear surface of said 50% mirror and onto said second projection screen, whereby said first video sequence and said second video sequence produce a single, virtual image which appears to the passenger to be positioned outside the elevator car.

9. The special effects elevator of claim 1 wherein said special effects controller is linked to said special effects equipment through an elevator control cable.

10. The special effects elevator of claim 9 wherein said special effects controller controls a video source, an audio source, a projector controller, and a lighting controller, all of which communicate with the special effects equipment through the elevator control cable.

11. A method for creating an illusion in an elevator, comprising the steps of:

providing an elevator for moving passengers from a first level to a second level, said elevator including an elevator car divided into a passenger compartment and a special effects equipment compartment, said passenger compartment having the appearance of a conventional elevator car including a door and having at least one partition which is opaque when the passenger compartment is illuminated, but which becomes transparent to reveal special effects when the passenger compartment is dark and the special effects equipment compartment is illuminated;

opening the elevator door to allow a passenger to enter;

closing the elevator door;

extinguishing the illumination in the passenger compartment and displaying the special effects to the passenger through at a predetermined position between the first level and the second level to create a predetermined illusion; and, opening the elevator door on the second level, allowing the passenger to exit the passenger compartment.

12. The method of claim 11 wherein said elevator is provided for moving passengers from an outside world into a theme park.

13. The method of claim 11 wherein said elevator is provided for moving passengers into a theme park attraction.

14. The method of claim 11 wherein said special effects are a predetermined special effects sequence including a video sequence accompanied by audio.

15. The method of claim 11 wherein said partition has a mirrored surface.

16. The method of claim 11 additionally including the step of allowing the passenger to push a button to cause the elevator to begin moving towards the second level.

17. The method of claim 16 wherein a special effects sequence is triggered when the passenger pushes the button to cause the elevator to begin moving towards the second level.

18. The method of claim 11 wherein the step of extinguishing the lights in the passenger compartment is preceded by flickering lights.

* * * * *

UNITED STATES PATENT AND TRADEMARK OFFICE

CERTIFICATE OF CORRECTION

PATENT NO. : 6,076,638
DATED : June 20, 2000
INVENTOR(S) : Gertz

It is certified that error appears in the above-identified patent and that said Letters Patent is hereby corrected as shown below:

Title page:

After "U.S. Patent Documents", please delete

| | | | |
|---|---|---|---|
| "2,888,857 | 6/1959 | Stevenson et al. | 472/58 X |
| 4,026,066 | 5/1977 | Reiner et al. | 472/71 X |
| 4,953,848 | 9/1990 | Braunstein et al. | 472/63 X |
| 5,346,433 | 9/1994 | Weinreich | 472/63 |
| 5,865,519 | 2/1999 | Maass | 472/58 X" |

and insert

| | | | |
|---|---|---|---|
| -- 2,888,857 | 6/1959 | Stevenson et al. | 472/58 X |
| 4,026,066 | 5/1977 | Reiner et al. | 472/71 X |
| 4,400,786 | 8/1983 | Mandel et al. | 364/513 |
| 4,577,177 | 3/1986 | Marubashi | 340/19R |
| 4,953,848 | 9/1990 | Braunstein et al. | 472/63 X |
| 4,995,479 | 2/1991 | Fujiwara et al | 187/397 |
| 5,056,629 | 10/1991 | Tsuji et al. | 187/397 |
| 5,346,433 | 9/1994 | Weinreich | 472/63 |
| 5,606,154 | 2/1997 | Doigan et al. | 187/396 |
| 5,844,181 | 12/1998 | Amo et al. | 187/396 |
| 5,865,519 | 2/1999 | Maass | 472/58 X --. |

Column 2
Line 19, please delete "provide" and insert -- provides --.
Line 28, please delete "the".
Lines 39-40, please delete "convention" and insert -- conventional --.

Column 4,
Line 43, please delete "15" and insert -- 16 --.

Column 5,
Line 24, please delete "is" and insert -- of --.

UNITED STATES PATENT AND TRADEMARK OFFICE

CERTIFICATE OF CORRECTION

PATENT NO. : 6,076,638
DATED : June 20, 2000
INVENTOR(S) : Gertz

It is certified that error appears in the above-identified patent and that said Letters Patent is hereby corrected as shown below:

IN THE CLAIMS:

Column 7,
Claim 8, in the first line of the claim, please correct the dependency by deleting "claim 2" and inserting -- claim 7 --.

Signed and Sealed this

Fourth Day of September, 2001

Nicholas P. Godici

*Attest:*

*Attesting Officer*

NICHOLAS P. GODICI
*Acting Director of the United States Patent and Trademark Office*